United States Patent [19]

Higo et al.

[11] Patent Number: 4,763,460

[45] Date of Patent: Aug. 16, 1988

[54] SEALING FOIL BREAKER FOR ANALYZER TEST CUPS

[75] Inventors: Yuji Higo, Nagoya; Hidechika Hayashi, Yokohama, both of Japan

[73] Assignee: Tosoh Corporation, Yamaguchi, Japan

[21] Appl. No.: 52,333

[22] Filed: May 21, 1987

[30] Foreign Application Priority Data

May 21, 1986 [JP] Japan ..... 61-117112

[51] Int. Cl.[4] ..... B67B 7/52; B26F 1/18

[52] U.S. Cl. ..... 53/381 R; 30/366; 30/402; 83/660; 414/412

[58] Field of Search ..... 53/381 R, 381 A; 83/866, 660; 30/402, 414, 366, 367, 164.8, 443; 72/325; 414/412

[56] References Cited

U.S. PATENT DOCUMENTS

| | | | |
|---|---|---|---|
| 1,689,047 | 10/1928 | Packer | 30/366 X |
| 1,962,415 | 6/1934 | Taccard | 30/443 |
| 2,060,888 | 11/1936 | Newman | 83/660 X |
| 2,390,309 | 12/1945 | Keys | 30/366 |
| 2,603,858 | 7/1952 | Bruce et al. | 30/402 X |
| 3,477,317 | 11/1969 | Liander | 83/660 X |
| 3,487,965 | 1/1970 | Gale | 414/412 X |
| 3,559,445 | 2/1971 | Hougen | 83/660 X |
| 3,739,471 | 6/1973 | Peres | 414/412 X |
| 3,775,829 | 12/1973 | Rice | 53/381 A X |
| 4,176,567 | 12/1979 | Weisberg | 83/660 X |

*Primary Examiner*—Horace M. Culver

*Attorney, Agent, or Firm*—Sughrue, Mion, Zinn, Macpeak and Seas

[57] ABSTRACT

A reciprocable vertical shafts 21 has a pyramid shaped lower tip for piercing a sealing foil 8*d* secured across the top of an analyzer test cup containing an active substance. The edges of the pyramid divide the foil into triangular segments which are pressed against the inner wall of the cup by the cylindrical root portion of the shaft such that they do not engage any of the active substance or interfere with subsequent injections into or withdrawals from the cup.

3 Claims, 5 Drawing Sheets

SEALING FOIL BREAKER FOR ANALYZER TEST CUPS

BACKGROUND OF THE INVENTION

1. Field of the Invention

This invention relates to a sealing foil breaker for test cups used in an analyzer for detecting and determining a very small quantity of a physiologically active substance in a sample liquid, especially in an enzyme immunity analysis (EIA).

2. Description of the Prior Art

Enzyme immunity analysis in which an enzyme is used as a sign of a combined product of a reaction of an antigen or an antibody has recently been studied and energetically developed as an immunological method of detecting and determining a very small quantity of a physiologically active substance.

Enzyme immunity analysis includes various methods, such as the sandwich method or competitive method, as disclosed in, for example, "Clinical Chemistry", Vol. 22, No. 8, 1243–1255 (1976). In a regularly used method, a competitive method, a conjugate with which an enzyme is combined as a sign is brought into contact with an antigen or an antibody fixed to an insoluble carrier to generate a reaction of the antigen or antibody and form a complex, and a substrate, which receives an active enzyme and causes an optically detectable change (in, for example, the fluorescent strength) to occur therein, is then brought into contact with this complex to determine an optical change of the substrate and measure the quantity of the antibody or antigen in an object sample liquid.

Since these operations are usually carried out for a plurality of samples, a device having a plurality of cells, such as a multi-titer plate has been provided and used in practice.

The method described above, in which such a multi-titer plate is used, is suitable for conducting measurements on the same inspection item or a certain number of a predetermined kind of inspection items. However, this method requires intensive labor preparations prior to the stage in which the practical measurements are conducted, particularly where the inspection items for each sample are varied when occasion calls.

SUMMARY OF THE INVENTION

Under these circumstances, the present inventors have proposed the following system to improve the practical operability and operation efficiency of the enzyme immunity analysis.

In this system, a special antibody (or antigen) corresponding to predetermined inspection items is bound to the surfaces of beads serving as insoluble carriers, and the carriers are placed in a cup type vessel whose upper opening is sealed. A plurality of groups of such test cups are prepared in advance for a plurality of inspection items. When a practical analysis is carried out, a test cup that corresponds to an inspection item necessary for an object sample is selected from the groups of test cups, and it is supported on a carrier and sent to an analyzer.

Such a system can be used very effectively, especially in an analyzer in which automated measurement is conducted.

The present invention has been developed to provide a seal breaker which can be suitably applied to a system in which the test cups described above are used.

An object of the present invention is thus to provide a sealing foil breaker for conveniently breaking the sealing foil of a test cup of the above-mentioned type in a stage prior to the stage(s) in which the measurements are conducted.

Another object of the invention is to provide a sealing foil breaker wherein the possibility of the broken foil adversely affecting a measurement operation carried out in the test cup in subsequent steps can be eliminated, so that no error occurs in an operation for determining a very small quantity of a substance.

The sealing foil breaker according to the invention comprises a wedge member having a pyramid shaped lower end for piercing the sealing foil of a test cup and moving down into the interior thereof, and a fluid cylinder for reciprocating the wedge member up and down with respect to the test cup. The root section of the wedge member has a diameter that allows it to fit closely within the upper opening of the test cup when the wedge member is moved down into the test cup, whereat a clearance is left between the pointed tip of the lower end and the beads in the bottom of the test cup.

The four sided pyramid shaped lower end of the wedge member divides the foil into four equal tongues and presses them against the inner surface of the test cup, thus avoiding any irregular segments. The sealing foil is apt to be broken irregularly when the lower end of the breaker has a simple conical configuration or more than six flat side surfaces converging at their lower ends.

In the previously mentioned analysis, a substance placed in a test cup and contributing to, for example, an immunological reaction comprises a special antibody (or an antigen) fixed to the surfaces of synthetic resin beads and a labeled antibody (or an antigen as a conjugate). These beads may contain magnetic bodies so that they may be vibrated in the test cup by a varying external magnetic field.

The test cup usually has a small capacity of not more than several milliliters, and is made of a transparent or opaque synthetic resin; the latter is more preferable for shielding the stray light.

The sealing foil preferably has a sufficiently high sealability and such fragility that it may be easily broken by a sharp jig. The foil may be a metal foil such as aluminum, or an aluminum coated plastic, film, but the material or the foil is not limited to these. The foil is generally heat sealed or bonded to the outer edge of the upper lip of the test cup. The foil breaking wedge member is made of metal, a ceramic material, or a hard synthetic resin.

DETAILED DESCRIPTION OF THE PREFERRED EMBODIMENT

Figure 1:
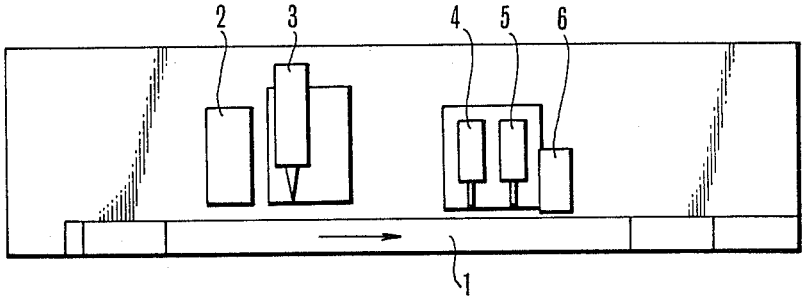
FIG. 1 shows a schematic example of an enzyme immunity analyzer in which a sealing foil breaker according to the present invention is installed.

The present invention will now be described taking as an example an enzyme immunity analyzer in which the sealing foil breaker shown in the drawings is installed.

Referring to FIG. 1, reference numeral 1 denotes a transfer passage along which a test plate 7 with test cups, which will be described later, arranged in order and supported thereon is conveyed in the direction of the arrow. Above the transfer passage a sealing foil breaker 2, a sample liquid injector 3, a B/F separator 4, a substrate injector 5 and a photometer 6 are arranged in the mentioned order from the upstream side of the passage to the downstream side thereof.

The sample liquid injector 3, B/F separator 4, substrate injector 5 and photometer 6 are respectively used to inject a predetermined quantity of a sample liquid into an opened reaction cell in a test cup, thereafter wash the interior of the reaction cell, i.e., remove a free antibody reaction complex which is not bound to the surfaces of the beads in the reaction cell from the interior thereof or subject the interior of the cell to B/F separation, inject into the B/F separated reaction cell a substrate which receives an active enzyme used as a sign on the antibody reaction complex to cause a detectable change to occur therein, and determine the change occurring in the substrate.

Figure 3:
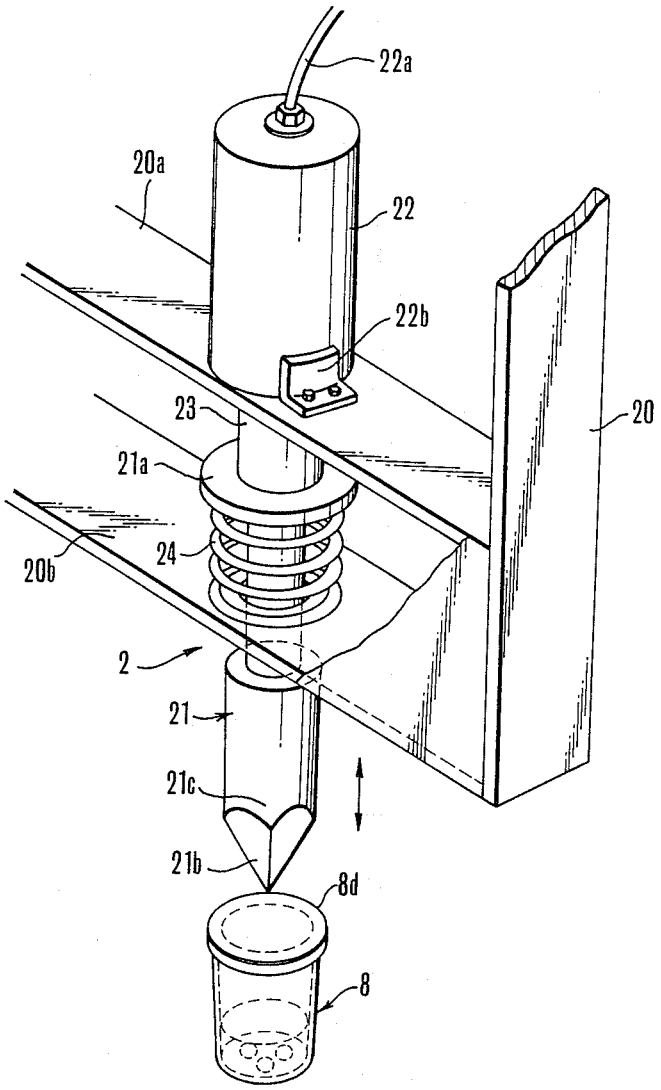
FIG. 3 is a perspective view showing the construction of the sealing foil breaker.
Figure 4A:
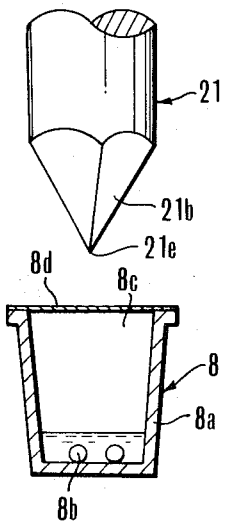
FIGS. 4(*a*), 4(*b*) and 4(*c*) sequentially illustrate the breaking of a sealing foil by a wedge type member.
Figure 4B:
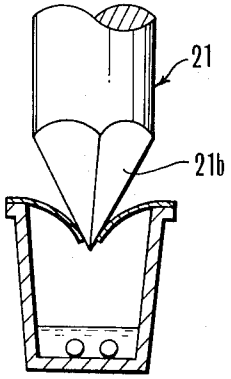

The test cup 8 referred to above, as shown in FIGS. 3 and 4, comprises an open cup type vessel body **8*a* containing a plurality of beads 8*b*, and a sealing foil 8*d* sealing an upper opening 8*c* of the vessel body. A special antibody (or antigen) is bound to the beads 8*b*** in advance.

Figure 2:
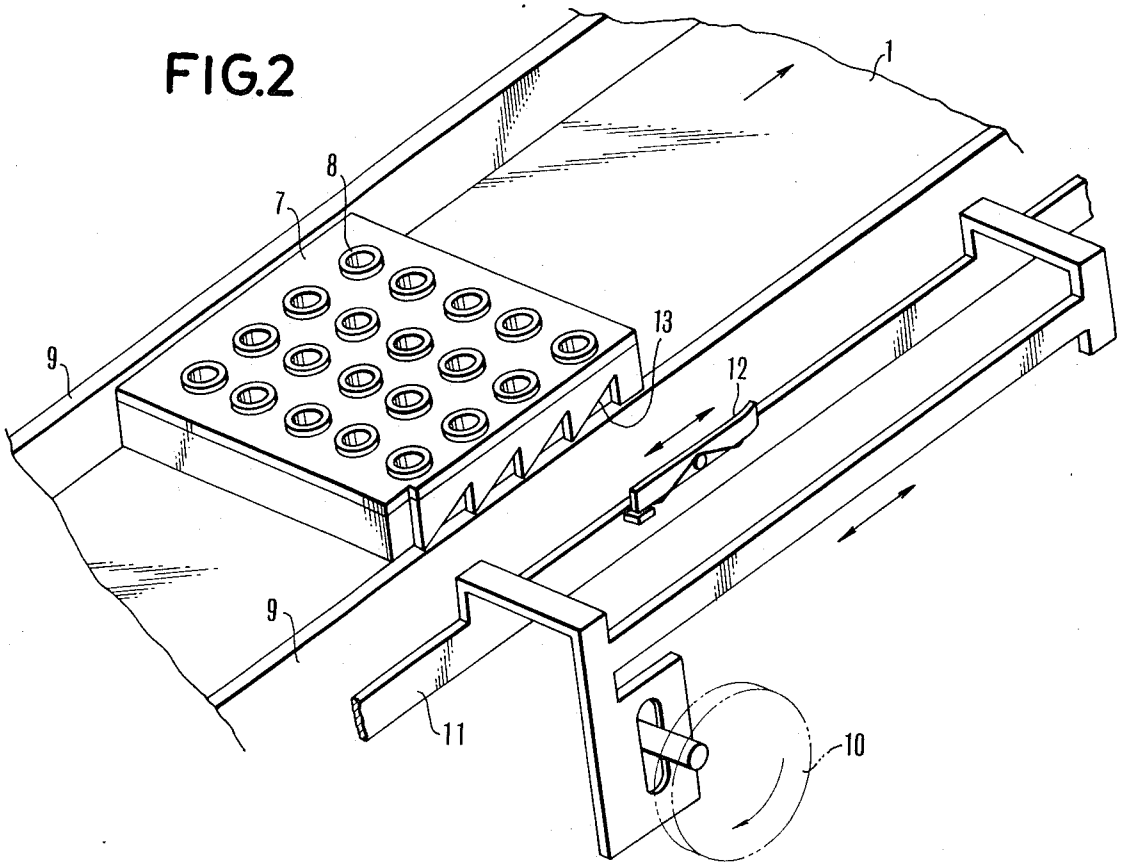
FIG. 2 is a perspective view of a test plate on which test cups are supported, and a transfer mechanism therefor.

The test tray or plate 7 is provided with a plurality of holes to accommodate a plurality of selected test cups 8 as shown in FIG. 2. The test plate is adapted to be conveyed along the transfer passage between its side plates 9, 9 by an intermittent drive mechanism shown in FIG. 2, wherein reference numeral 10 denotes an eccentric cam, 11 is a transfer bar, 12 is a ratchet pawl attached to the transfer bar, and 13 are ratchet teeth formed in a side wall of the test plate 7 and adapted to be engaged by the ratchet pawl. With such a drive mechanism the test plate 7 is conveyed step-by-step or intermittently to positions below the devices shown in FIG. 1, in succession.

The sealing foil breaker 2 comprises a shaft 21 supported on a lower member **20*b* of a fixed frame 20 for vertical reciprocation, an air cylinder 22 having a downwardly extending plunger 23 engaging a flanged upper head 21*a* of the shaft, and a return spring 24 urging the shaft in the upward direction to maintain engagement between the head 21*a* and plunger 23. When air is supplied from a source (not shown) into the cylinder 22, the plunger 23 and shaft 21 are driven downwardly such that the sealing foil 8*d* of a test cup positioned below the shaft is pierced by its sharp lower tip 21*b*. Reference numeral 22*a* denotes an air supply line extending to the cylinder 22, and 22*b* is a bracket for mounting the cylinder to an upper frame member 20*a***.

Figure 4C:
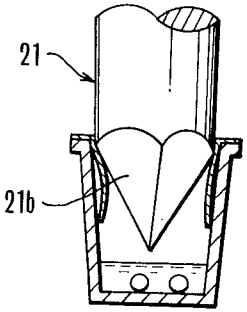

The lower tip **21*b* of the shaft has four flat side surfaces converging at their lower ends in a pyramid shape. The length of the tip is sufficiently less than the height of the test cup 8 as shown in FIG. 4*c*, so that, even when the shaft 21 is moved down to a maximum extent into the test cup, the sharp piercing point 21*e* of the tip does not contact the beads 8*b*** in the cup.

The diameter of the base or root section **21*c* of the shaft is slightly smaller than that of the upper opening 8*c* of the test cup. For example, the diameter of the section 21*c* is 9.3 mm while the diameter of the outer opening 8*c*** is 10 mm.

When a sealing foil is broken by the apparatus described above, it is centrally pierced by the downward movement of the shaft 21 as shown in FIG. 4 and divided into four triangular tongue-like segments which are bent downwardly and pressed against the inner surface of the test cup (FIG. **4*c***). This maintains the upper opening of the test cup unobstructed after the shaft is withdrawn, and the retention of the segments on the upper lip of the cup prevents them from absorbing any injected samples or otherwise adversely affecting the accuracy of any measurements made.

Figure 5:
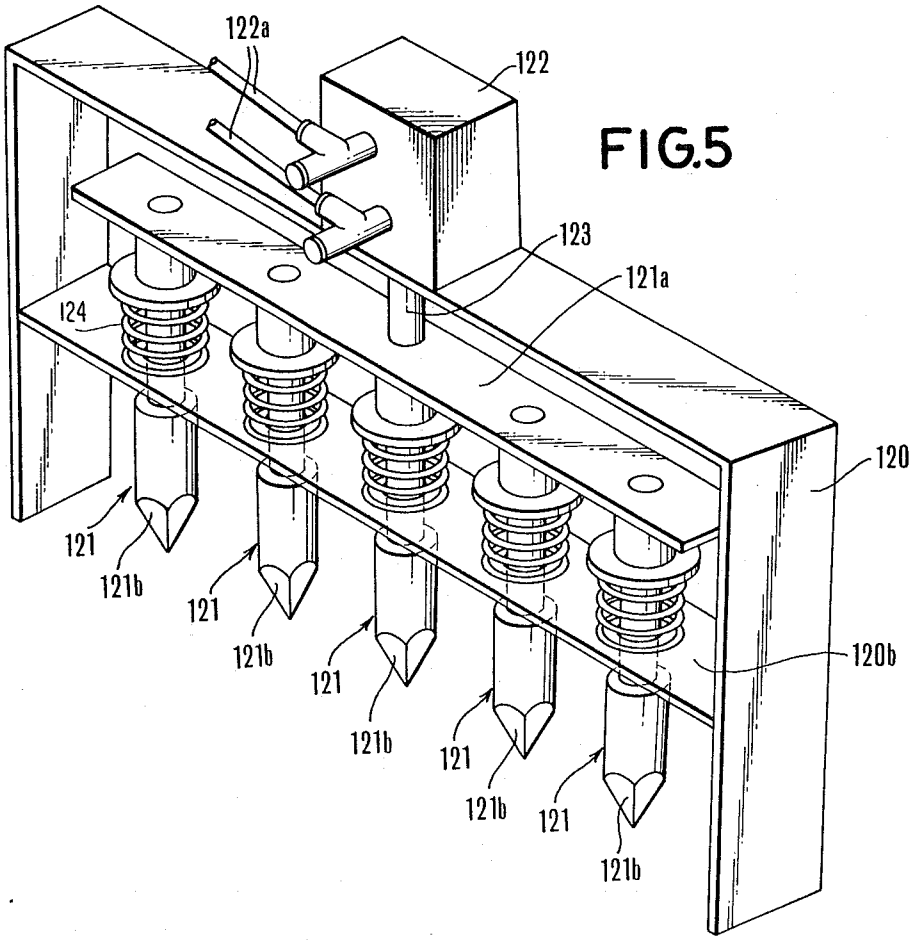
FIG. 5 is a perspective view showing the construction of a multiple-shaft type sealing foil breaker according to the present invention.

Although only a single foil breaker is shown in FIGS. 1 and 3, a transverse row of, for example, five such breakers could be combined as shown in FIG. 5 to simultaneously pierce a plurality of sealing foils of the test cups in the conveyor tray of FIG. 2. In FIG. 5, five spring biased breaker shafts 121 are fixed to a stopper plate **121*a* which is moved up and down by the plunger 123 connected to a double-acting air cylinder 122. The air cylinder is controlled by a speed controller 122*a* comprising a pair of air pressure tubes connected to an electromagnetic valve (not shown). The springs 124** may be omitted totally or partially.

What is claimed is:

1. An apparatus for breaking a sealing foil (**8*d*) secured to an upper lid of an analyzer test cup (8) and closing an otherwise open top (8*c***) of the cup, said cup containing a reaction generating substance, comprising:

(a) stationary mounting means (20), (b) transport means (1, 7) for retaining and conveying said sealed test cup past and below said mounting means, and (c) a sealing foil breaker (2) secured to the mounting means and comprising:

(1) at least one downwardly depending, vertically oriented, cylindrical, reciprocable shaft (21) having a pointed lower tip defined by a plurality of less than seven flat side faces converging in the shape of a pyramid, the diameter of a root portion of said shaft just above the tip being slightly less than the diameter of the top of the cup, and (2) actuator means (22) disposed in engagement with said shaft for selectively driving said shaft downwardly a predetermined distance sufficient for the tip of the shaft to centrally pierce the sealing foil of a test cup axially aligned with and disposed below the shaft such that the foil is divided into said plurality of generally triangular, tongue-like segments and said segments are individually pressed against the inner wall of the cup by the root portion, with a clearance remaining between the tip of the shaft and the reaction generating substance in the cup.

2. An apparatus according to claim 1, wherein the actuator means comprises a fluid cylinder disposed above and in axial alignment with the shaft, a plunger (23) extending downwardly from the cylinder, and spring means (24) for biasing an upper end of the shaft into engagement with a lower end of the plunger.

3. An apparatus according to claim 1, comprising a plurality of said shafts arranged in a row and fixed to a stopper plate (**121*a***), and wherein the actuator means is disposed in engagement with said stopper plate for simultaneously driving said shafts.

* * * * *